United States Patent [19]

Omana

[11] 4,282,852

[45] Aug. 11, 1981

[54] AIR RIFLE WITH PISTON IMPELLED BY COMPRESSED GAS

[76] Inventor: Julio A. Omaña, Coronel Bogado 2480, Boulogne, San Isidro, Buenos Aires, Argentina

[21] Appl. No.: 47,990

[22] Filed: Jun. 13, 1979

[51] Int. Cl.[3] ..... F41B 11/00; F41F 1/04

[52] U.S. Cl. ..... 124/67

[58] Field of Search ..... 124/65, 66, 67, 68, 124/69, 70, 85, 27, 61

[56] References Cited

U.S. PATENT DOCUMENTS

| | | | |
|---|---|---|---|
| 679,670 | 7/1901 | Hamilton | 124/85 |
| 1,486,215 | 3/1924 | Zerbee | 124/69 |
| 2,132,173 | 10/1938 | Lefever | 124/67 |
| 2,151,676 | 3/1939 | Appleby | 124/67 |
| 2,923,286 | 2/1960 | Draganti | 124/70 X |
| 2,924,211 | 2/1960 | McSwain | 124/61 |
| 3,308,803 | 3/1967 | Walther | 124/69 |
| 4,038,961 | 8/1977 | Olafsson | 124/69 |
| 4,120,276 | 10/1978 | Curran | 124/85 |

FOREIGN PATENT DOCUMENTS

| | | | |
|---|---|---|---|
| 128429 | 7/1948 | Australia | 124/67 |
| 452398 | 5/1968 | Switzerland | 124/67 |
| 530162 | 12/1976 | U.S.S.R. | 124/65 |

*Primary Examiner*—Richard T. Stouffer

*Attorney, Agent, or Firm*—LeBlanc, Nolan, Shur & Nies

[57] ABSTRACT

A compressed air rifle comprising a cylinder containing a freely slidable piston that divides the interior of the cylinder into a rear chamber adapted to be charged with a compressed gas and a forward chamber defining an air compression chamber, a unidirectional valve for charging the rear chamber with compressed gas, a member mounted on the forward end of the cylinder having a rifle barrel guide and a projectile insertion opening, an open-ended rifle barrel coaxial with said cylinder slidably mounted in the guide for movement between a first loading position wherein it may receive in its forward open end a projectile inserted through the insertion opening, a second position wherein it has been thrust into said cylinder sufficiently to push the piston into locking engagement with a trigger controlled latch, and a third firing position wherein it closes the insertion opening and its rear open end is substantially at the forward end of the compression chamber whereby when said trigger is actuated to release the piston the piston is impelled by compressed gas to move forwardly in the cylinder to compress air in the compression chamber and drive the projectile through the barrel, movement of the rifle barrel between those positions being effected by a pivotally and slidably mounted loading lever having a releasable toothed connection to the barrel and a traction rod pivoted at opposite ends on the member and rifle barrel.

10 Claims, 9 Drawing Figures

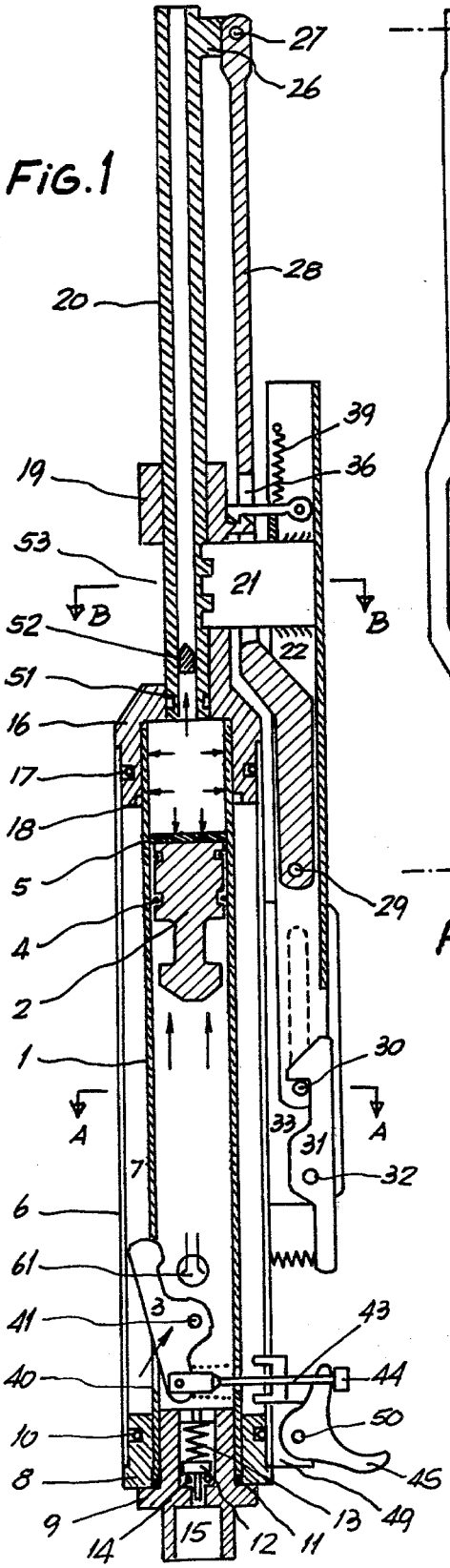
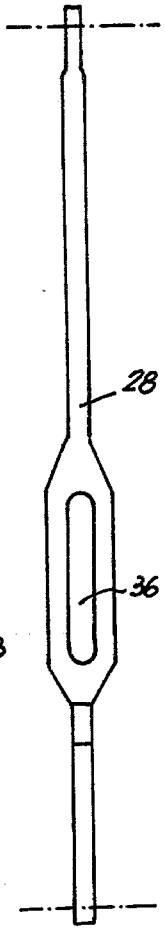
FIG. 2
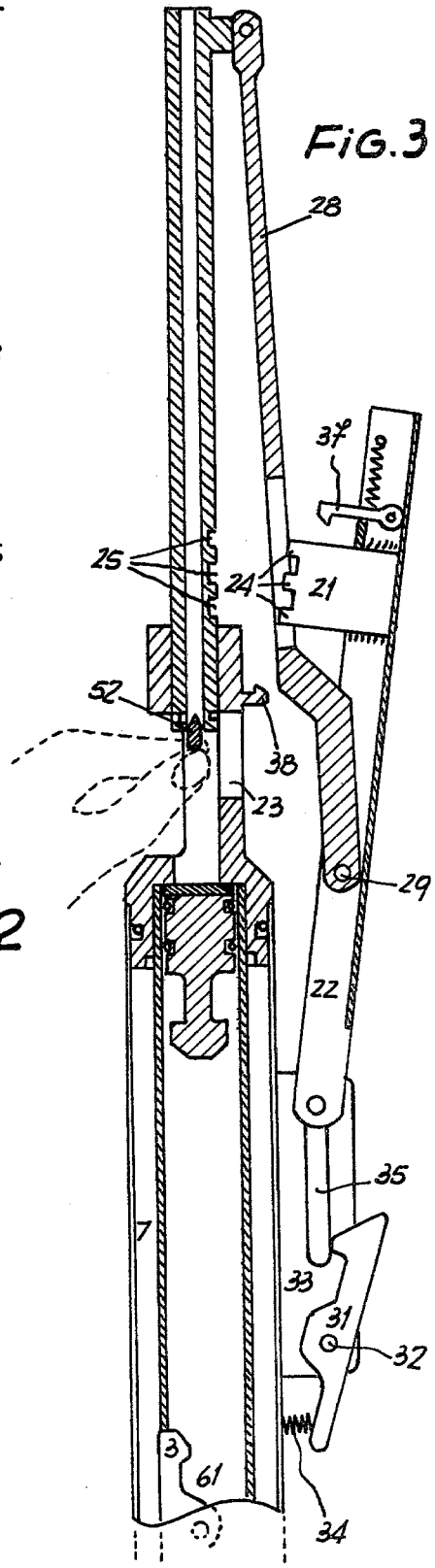

FIG. 4
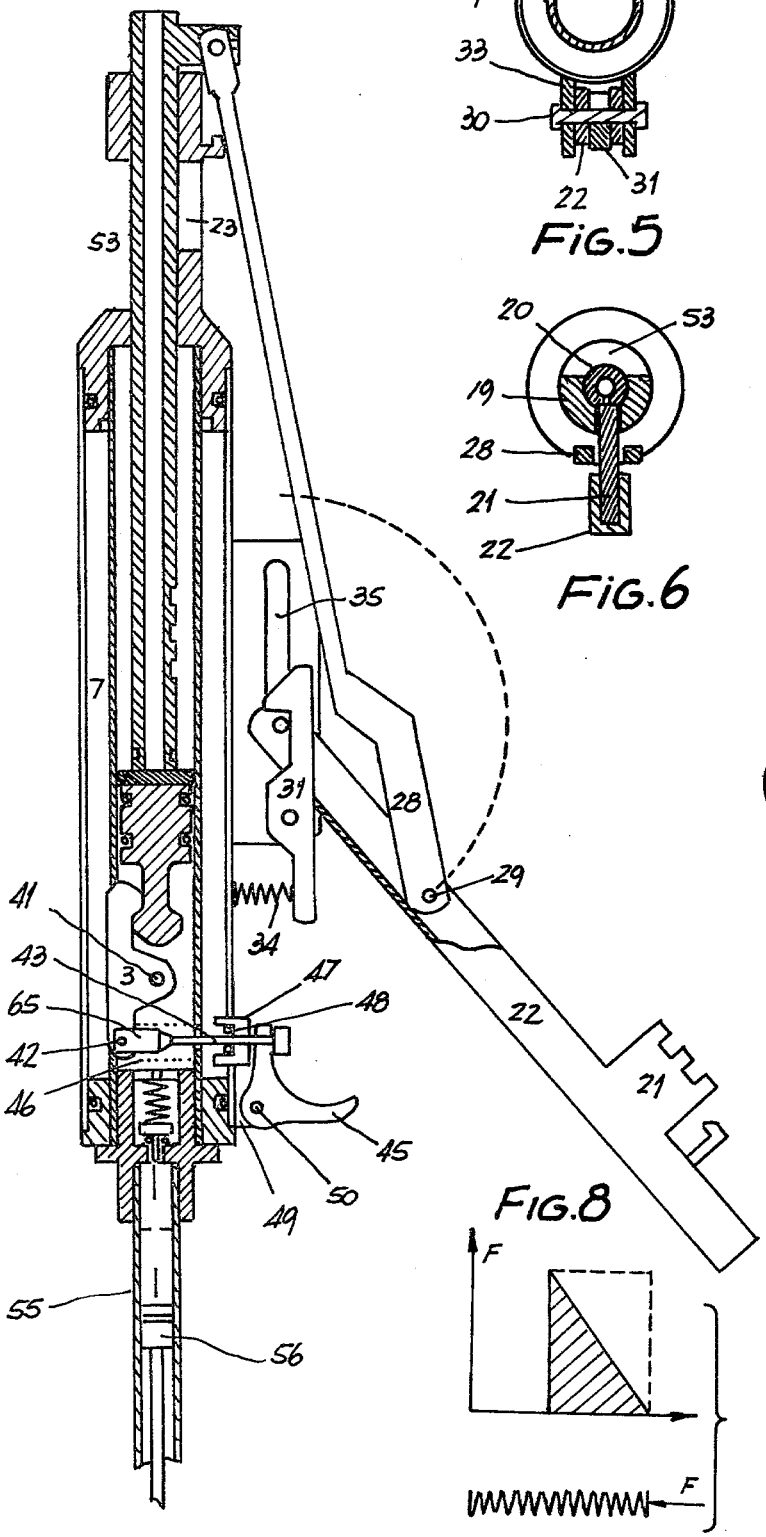
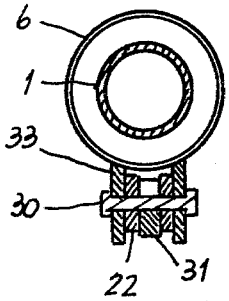
FIG. 5
FIG. 6
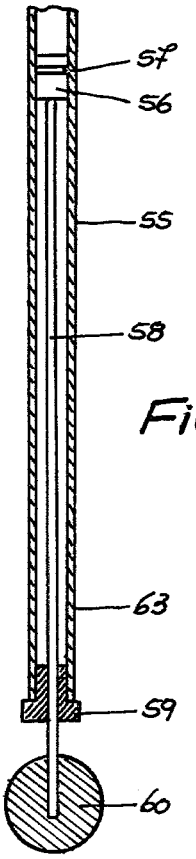
FIG. 7
FIG. 8
FIG. 9
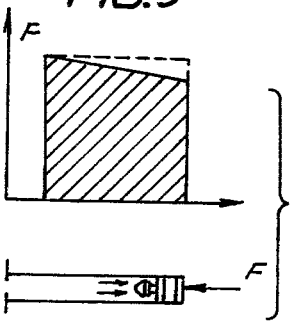

AIR RIFLE WITH PISTON IMPELLED BY COMPRESSED GAS

DESCRIPTION

A compressed air rifle of variable power, actioned by compressed air, consisting basically of two concentric tubes of different diameters with their corresponding ordinary locking caps. The inner tube has in its interior an air compressor piston which is driven by the pressure of the gas compressed in a deposit situated between the inner and outer tubes. The barrel is aligned coaxially with the two tubes and serves also as a cover for the inner compressing tube, and it is sustained and guided by bushing which is an extension of the forward cover of the two tubes, and can be moved forward by means of manually operated lever system, in order to introduce the missile into the barrel through an opening in the bushing, and backward to push the piston against the gas pressure to the bottom of the inner tube where it will be retained until the firing by means of a catch spring, the barrel returning to its normal position for firing, and remaining fixed in this position by means of a locking device which holds it immobilized until the rifle is fired. When the catch spring is actioned by the firer it frees the piston which is impelled at speed by the pressure of the compressed gas in the deposit, compressing in its turn the air contained in the inner tube which impels the missile along the barrel.

This rifle was developed basically to provide a weapon of variable power which could serve both for hunting and for target shooting or for entertainment, as by firing it at low power it allows for practising shooting without any risk. By duly increasing its power it can be used for long distance shooting or hunting as its maximum power is very much higher than that of the known compressed air rifles.

The known compressed air rifles function by compressing the air by means of a strong metal spring, which is the cause of their limitations because their power is unvariable as there is no practical manner of varying the compression force of the spring, and as regards the power with which they can fire the missile, this is proportional to the mechanical task of manually loading the rifles, i.e. of the spring's compression. FIG. 8 is a diagram showing the loading forces in relation to the distance covered by the end of the spring, representing the antagonistic forces which the spring opposes to its compression. The force is nil at the beginning and at a maximum at the end of the compression, with a lineal characteristic which is typical of metal springs. The compression task is represented by the shaded triangular area, according to the well known physics formula: work=force×distance, which as in this case the force varies lineally from zero to its maximum value, the average value is taken to obtain the shaded area. If the loading force would have been constant, the compression task would have been that represented by the dotted line rectangular in FIG. 8.

From the above can be seen the fundamental aspects which limit the power of rifles using springs: One is that the loading force of the spring varies considerably from zero to its maximum value which prevents optimum advantage being taken of the compression stroke with respect to that obtainable if the force were constant. Another is that the compression length of the spring is limited by the deadweight of its spirals when in contact, that is to say, for example, that a spring will have a usable compression length equivalent to 40 or 50% of its total length. Finally, it is not possible, either, to obtain great compression forces because of the physical dimensions that the spring must have, such as the diameter of its spires, thickness of its wire, etc., in relation to a rifle of normal dimensions. These factors, overall, do not allow for the accumulation of a great quantity of energy from the compression task as to be able to obtain great power, as the maximum loading force being limited to the physical possibilities of the user, the compression characteristic of the spring implies a great energetic waste in relation to a spring of a constant loading force. Also the compression stroke is short in relation to the dimensions of the rifle, as seen above with regard to the length of the spring with its spirals in contact.

All these drawbacks are overcome in the compressed air rifle I have invented, by the use of compressed gas (preferably compressed air) to impel a piston along the length of the tube, compressing the air which impels the missile. This compressed gas which impels the piston is contained in an air tight chamber in communication with the hind end of the compressor tube along which the piston travels, the force acting on the piston being equal to the pressure of the gas multiplied by the sectional area of the piston. The force acting on the piston can then be easily varied by merely varying the pressure of the gas, and thus varying the power of the rifle.

It can be seen also that here there does not exist the limitation of the spring of having a minimum compression length because of the contact between the spires, as the piston can travel the length of the compression tube, which means, in relation to the dimensions of a normal rifle, to be able to obtain a greater compression stroke of the piston and thus greater accumulated energy, which means greater power. The force acting on the piston is, furthermore, almost constant, which allows for taking excellent advantage of the physical possibilities of the user to accumulate great energy in the gas during the task of compression of the piston, which will be transformed into kinetic energy of the missile. FIG. 9 is a diagram showing the necessary force to compress the piston in relation to its stroke, and is shaped approximately like a trapezoid whose shaded area represents the energy accumulated in the gas which shall be delivered to the missile, and which shall be greater if, with the same base (compression stroke), the force were, for example, zero, which would imply a triangular diagram. In other words, if the force were constant, the greatest power would be obtained for a determined piston stroke. To illustrate what happens in this case, I shall apply the law which covers adiabatic transformations: $P_1 \times V_1^k = P_2 \times V_2^k$ it being that:

$P_1$=pressure of the gas in the deposit with the piston in the forward part of the compression tube.

$P_2$=pressure of the gas in the deposit with the piston locked in the hind part of the compression tube (at the end of the stroke).

V=volume of the deposit of compressed gas.

DV=volume displaced by the piston in its stroke along the tube.

For the application of the above-mentioned law, the following shall be performed:

$$V_1 = V + DV$$

(initial volume before the compression stroke equal to the volume of the deposit plus volume displaced by the piston)

$$V_2 = V$$

(Final volume equal to the volume of the gas deposit)

For the application of the above mentioned law, the following shall be performed:

$$P_1 \times (V + DV)^k = P_2 \times V^k$$

and to find the value of $P_2$:

$$P_2 \times \left(\frac{V + DV}{V}\right)^k = P_1 \times (1 + DV/V)^k$$

The quotient DV/V expresses the relationship between the volume displaced by the piston stroke and the volume of the gas deposit. If this value were, for example, 1/5, and compressed air were used, k=1.4 it would be:

$$P_2 = (1 + 1/5)^{1.4} = 1.29\ P_1$$

That is to say that the pressure at the end of the stroke would be 29% higher than the initial pressure. If a 1/10 relationship were used it would be 14% higher than the initial pressure (and therefore, than the force). This indicates that the diagram of the task performed to compress the piston, and that save for losses due to friction, etc., shall be transmitted to the missile, shall be trapezoidal. This means in practice that if a man can exercise a maximum force of, say, 80 kgs. against the piston during the loading, and the stroke were of 0.80 m., the ideal would be that he could exercise the full 80 kgs. during the whole of the piston stroke (rectangular diagram), the resulting accumulated energy being $E = 80 \times 0.20 = 16$ kgs. If, on the other hand, the initial force were 60 kgs. and the final force 29% higher, (as in the case of the example), that is $1.29 \times 60 = 77.4$ kgs., it would be $E = \frac{1}{2}(60 + 77.4)$. $0.20 = 13.74$ kgs. Therefore, for a given piston stroke and a highest possible force to be exercised against the piston, the energy transmitted to the missile shall be higher while the nearer the loading diagram approaches a rectangular. It is easy to appreciate the advantages achieved with the rifle I have invented with regard to those already known: Variable firing power by merely varying the pressure of the gas in the deposit, the maximum power being limited solely by the physical strength of the user or by the mechanical resistance of the rifle. In a conventional spring rifle, this would be equivalent to changing the spring for another with different compression characteristics. It is not necessary to stress the versatility of this rifle, which can be used for various purposes, as for example, entertainment or informal target shooting by youths, using its low powers, or for long distance shooting or hunting, using its high powers, which always can be graduated to the needs of physical loading possibilities of the user.

Furthermore, with an almost constant loading force and a long piston stroke (there is no misused space due to spring spires), great power can be obtained very much higher than that of known compressed air rifles.

The spacious design of the air compressing chamber, through which the piston runs, contributes greatly to this high power, the forward closure of the chamber being formed directly by the hind end of the barrel where the missile is inserted. The compressing piston hits directly against the barrel, thus achieving the elimination of all noxious space which normally diminishes the performance of compressed air rifles. It also eliminates the problem of the metal springs, which suffer from fatigue from long use and gradually weaken, thus causing these rifles to lose power.

The security of this system of using compressed gas should also be stressed, as it allows the gas deposit to be totally emptied, thus making it impossible to fire the rifle and preventing accidents to non experts who might handle it. The ease with which a non expert can be instructed in handling the rifle is also notable, as it can be done by using a minimum power until the learner has acquired sufficient dexterity and then gradually increasing the loading force and consequently the power.

In essence, and summarising the above, this new compressed air rifle uses the expansive force of compressed air or other gas in a deposit to impel a piston along the length of a compression tube and compressing the air ahead of it to shoot the missile through the barrel. It should be noted that the gas in the deposit is not lost with every firing, as the piston has air tight sealing rings which prevent the passage of the gas, and acts as a spring of special characteristics as explained above. After every firing the piston returns to where it is held by the spring catch, being pushed by the barrel of the rifle which moves back by a system of levers operated manually by the user. Operating the levers inversely, the barrel moves forward to its normal firing position where it is held by means of a locking device, the rifle then being ready for firing (a missile having been inserted previously). It is important to note that the fundamental principle of this new rifle is the use of a compressed elastic fluid, i.e. compressed gas to impel the released piston, not mechanically connected to the rifle. This means that any appropriate gas can be used to fill the deposit, although preferentially the gas used should be air, because of the ease with which the deposit can be filled with manual compressors and its greater availability.

In order to make the functional and constructive characteristics of this invention easily comprehensible, there follows a detailed description of an example of the compressed air rifle, which is illustrated in the attached drawings, it being made clear that because it is an example, a limitative character should not be assigned to the scope of protection of this invention patent, as it has an explicative and illustrative finality on the basic conception of the invention.

Before beginning the description reference shall be made to the significance of the various drawings for purposes of greater clarity.

FIG. 1 shows a lengthwise section of the compressed air rifle as it is being fired.

FIG. 2 is a top view of the traction rod on the barrel of the compressed air rifle.

FIG. 3 shows the same section shown in FIG. 1 of the rifle while it is being loaded with the missile.

FIG. 4 shows the same section during the operation of pushing back the piston until it is held by the spring catch.

FIG. 5 shows the section A—A of the rifle indicated in FIG. 1.

FIG. 6 shows the section B—B indicated in FIG. 1.

FIG. 7 shows a lengthwise section of a manual compressor forming part of the compressed air rifle.

FIG. 8 is a diagram showing the loading forces in relation to the distance covered by the spring of a known compressed air rifle.

FIG. 9 is a diagram showing the necessary forces to compress the piston of the compressed air rifle of the present invention in relation to its stroke.

With reference to FIG. 1, it can be seen that the rifle is formed by a cylinder tube (1), with inside polished walls, which forms the air compression chamber for impelling the missile. Within this compression tube there is an air compressing piston (2), whose section is of a cylindrical form similar to that of the compression tube (1), which has a deep groove in its hind part for the purpose of the piston being held by the spring catch (3). On the periphery of the piston there are at least two shallow grooves which house gas sealing rings, preferably thoric and made of synthetic rubber, which rub against the walls of the compressor tube (1). These rings, indicated under number (4), prevent the leakage of gas and air in one and another direction, ensuring that the piston be air tight. At the front of the piston there is a disc of elastic material to absorb the shock of the impact of the piston against the end of the compressor tube, indicated as (5) in FIG. 1. This compressor tube (1) is completely surrounded by another concentric tube (6) which forms the compressed gas deposit (7) for impelling the piston. Both tubes are closed in their hind ends by a cap (8), which is a cylindrical cover with an external perimetric rabbet which penetrates the tube (6), and a central perforation of the same external diameter of the tube (1) in whose hind end it is inserted. Around the external rabbet, the cover (8) has a groove which houses an elastic gas sealing ring, preferably thoric and made of synthetic rubber (10). This cover is held in place against the pressure of the gas by the cylindrical stopper (9) which has a rim which sits on the cover (8) and which is screwed into the hind end of the tube (1). The air tightness of the joint is ensured by the thoric synthetic rubber ring (11). The stopper (9) serves also as the seat for the gas retaining and admission valve (12) which, pushed by the spring (13) against the face of its seat, where the thoric synthetic rubber ring is (14) prevents the leakage of gas from the deposit, but allows the entry of gas to fill the deposit. The hind part of the stopper (9) has a cylindrical tapped cavity (15) to which the compressor pump is screwed for filling the deposit with gas as illustrated in FIG. 4.

Both tubes (1) and (6) are closed in their forward end by a cylindrical cover (16) with a central perforation, of two different diameters, in the largest of which, which is tapped and begins in the hind end of the cover (16), is screwed the forward end of the compression tube (1) up to the section reduction of the perforation. This reduction serves as a partial closure of the compression chamber (completed by the barrel of the rifle) and as a stop collar for the piston (2). On its external perimeter the stopper (16) has a rabbet for plugging into the tube (6) which forms the air deposit. The air tightness of the joints to prevent leakages of gas from the deposit is achieved by thoric synthetic rubber rings (17) and (18) housed in grooves on the rabbet plugged into the tube (6) and on the edge of the central perforation into which the tube (1) is screwed.

The stopper (16) is extended forward in the form of a cylindrical bushing (19) with its central perforation of the same diameter as the barrel of the rifle and coaxial with the compression tube (1), it being a continuation of the perforation into which the compression tube is screwed. This perforation serves to hold and guide the barrel (20) of the rifle, which in the firing position completes the closure of the compression tube (1), its hind end remaining coincidental with the section reduction which serves as a stop collar for the piston, as mentioned previously. The barrel is immobilised in this position by means of a locking device (21) attached to the loading lever (22). The device (21) enters tightly into a longitudinal slot (23), FIGS. 3 and 4, of the bushing sustaining the barrel, and by means of the teethed projections is inserted in coincidental notches (25) of the barrel (20). For greater clarity, FIG. 6 shows a transversal section B—B of the rifle where the locking action of the device (21) can be appreciated, The bushing (19) has in its upper part a recess which uncovers part of barrel, and which is for the purpose of inserting the missile into the barrel. This recess (53) is also shown in the section B—B in FIG. 6. The barrel has in its hind end a perimetral groove (51), which houses a gas sealing ring preferably thoric and made of synthetic rubber, which is in contact with the internal walls of the sustaining bushing (19) for the purposes of preventing leakage of gas compressed by the stroke of the piston (2), the gas thus being totally destined to impel the missile.

On its forward end the barrel has a projecting flange (26) to which is articulated by means of the bolt (27) the traction rod (28) formed by a long bar with an S-shaped curve near its other end, and flattened before said curve, as illustrated in FIG. 2, which is a top view of the bar (28). The flat part has a groove (36) for the passage of the locking device of the barrel (21) and the clasp of the loading lever (37). The traction rod (28) is joined to the loading lever (22) by means of the bolt (29).

The loading lever (22) is a long bar with a U-shaped section the opening of which faces upwards. The articulation of the traction rod is within this opening. The locking device (21) is also within this opening being joined to the lever by soldering or other bond. All these details are clarified in the section B—B of FIG. 6.

The loading lever (22) is joined to the main body of the rifle, which includes the tube (6), by means of the bolt (30) passing through the lever near its hind end which, normal to its two sides and jutting out from them, rests on two slots of its same diameter, parallel to the axis of the rifle, cut in two flanges parallel to the axis of the rifle and attached to the tube (6).

The bolt (30) can run back and forth along the slots (35) of the flanges (33) from one end to the other always provided the locking device (21) is not locked to the barrel. As the lever (22) and the rod (28) will follow this movement, the barrel can be slid forward accompanying this displacement. To prevent this movement, the bolt (30) is retained against the hind ends of the slots by means of the retaining clasp (31), which is joined to the flanges (33) by means of the bolt (32) on which it can swivel as shown in FIG. 3, by manual pressure on its hind end to overcome the resistance of the spring (34). In this position, the hook at the forward end of the clasp (31) will be lower than the slots and will allow the free forward displacement of the bolt (30). This mechanism can be appreciated in the section A—A of FIG. 5. When the loading lever (22) is operated manually downwards and backwards for the barrel to push the piston back, the clasp (31) under pressure from the spring (34), maintains the position shown in FIGS. 1 and 4, with its hook preventing the forward movement of the bolt (30). The lever (22) will then swivel on the bolt (30).

The locked position of the loading lever (22), with the locking device (21) locked to the barrel in the firing position, is achieved by means of the clasp (37) which hooks on to the catch (38) in the bushing (19), the locking being ensured by the spring (39). To operate the loading lever this clasp is unhooked manually.

The retention of the piston (2) at the hind end of the compression tube (1) is achieved by means of the spring catch (3) which is a flat and long device placed in a longitudinal groove in the compression tube, and joined to it by means of the bolt (41) which runs through its middle and on which the catch swivels. The spring catch has in its forward end a hook pointing downwards, concordant with the perimetral groove at the hind end of the piston (2), for the purpose of holding the piston as shown in FIG. 4.

The hind end of the spring catch (3) is articulated to a cleft at the top of a cylinder (65) by means of the bolt (42). The rod (43), which is screwed into the lower end of the cylinder extends through the tubes (1) and (6) to the exterior of the gas deposit (7) to join the trigger (45) by means of the head (44) on which one of the two ends of the trigger (45) rests. The trigger is curve-shaped and is articulated in its middle section by means of the bolt (50) between two parallel flanges (49) joined to the tube (6). The trigger is a lever which, when the finger of the user presses back its lower end, causes the trigger to swivel and its upper end to move downwards, pulling down the rod (43) and forcing the spring catch (3) to swivel counter clockwise so that its forward hook frees the compressor piston. The spring catch returns to its original position under pressure from the recovery spring (46), which surrounds the rod (43), rests on the internal wall of the tube (1) and presses upwards against the hind end of the spring catch (3).

To ensure that the gas deposit (7) remains air tight, the rod (43) exits through the central hole of the bushing (47), which has a cavity housing the thoric synthetic rubber ring (48), which presses around the rod (43) and prevents leakages of gas. The compressed gas deposit (7) connects with the compressor tube (1) by means of orifices such as (61), the slot (40) and others not illustrated, but all BEHIND the sealing rings (4) of the piston (2) when the piston is held by the spring catch (3). If such were not the case, the gas from the deposit would escape ahead of the piston, as the piston is, precisely, a movable sealing cover for the deposit.

Normally, the gas to be used to impel the compressor piston would be air, and the filling of the deposit (7) is done by means of a simple manual compressor pump, similar to a bicycle pump, etc., as illustrated in FIG. 7. The body of the pump (55) is threaded externally in its fore end to enable it to be screwed into the hind cavity (15) of the cover (9) as illustrated in FIG. 4. The compressor piston (56) moves back and forth inside the barrel with at least one preferably thoric and synthetic rubber ring (57). The piston is pushed by the rod (58) guided by the screwed on bushing (59) and on its outside end it carries a handle (60). The barrel (55) has an orifice (63) near its hind end by which the air enters when the piston (56) has effected an aspiration stroke and is placed near the bushing (59). There follows an explanation of the functioning of this new compressed air rifle in order that the connection and significance of its various components can be fully understood.

When air is used the filling of the gas deposit (7) is carried out, as already explained, with a manual compressor pump of FIG. 7 screwed into the cavity (15). By repeated pumping the air is introduced through the valve (12) until the desired pressure is obtained. Previously a certain amount of mineral oil, such as that used in cars, shall have been introduced in the pump, for the purposes of causing within the deposit (7) a cloud for lubricating the internal mechanisms and sealing rings which ensure air tightness. To fire the rifle, the compressor piston (2) must be pushed back until it is engaged by the spring catch (3). This is done by unlocking the loading lever (22), moving forward the clasp (37). The user, exerting manual effort, then makes the loading lever (22) swing downward and backward, swivelling it on the bolt (3). This circling movement drags the hind end of the rod (28) in a circular course as indicated by the dotted line in FIG. 4. The movement of the rod pulls the barrel backward in a straight line, guided by the bushing (19), and the piston (2) is pushed back overcoming the resistance of the gas pressure in the deposit until it is engaged by the hook of the spring catch as illustrated in FIG. 4. (For this to happen the spring catch (3) will have moved upwards, pushed by the wedge-shaped piston, and will have returned to its normal position under the effect of the recovering spring (46). The final position of the loading operation is as shown in FIG. 4, it being noted that the loading lever (22) swivels on bolt (30), the latter being retained at the hind end of the slots (35) by the clasp (31). The mechanical work load effected, i.e. the energy delivered to the compressed gas of the deposit, is represented by the shaded part of the trapezoid in FIG. 9, the minor ordinate representing the initial compression force, the major ordinate the final force, and the base the piston stroke. Then with an inverse movement of the loading lever, the rod (28) is pushed forward and, as a result, also the barrel which returns to its original position. To insert the missile (52), the hind end of the clasp (31) is pressed, overcoming the resistance of the spring (34), and the forward end drops releasing the bolt (30). Pushing forward the lever (22) the bolt (30) will move along the slots (35) to their forward end. The rod (28) will push forward the barrel (20) in the same measure, its hind end remaining on a level with the opening in the bushing (19). The missile (52) can now be inserted through the opening (53) in the manner illustrated in FIG. 3.

This operation is effected without having inserted the locking device (21) in the groove (23) of the bushing (19) to lock the barrel. Once the missile has been inserted, the barrel returns to its original firing position by pushing back the loading lever (22) until the bolt (30) is again engaged by the retaining clasp (31). Now the locking device (21) is inserted in the groove (23), by firmly pushing up the lever (22 until the teeth (24) fit firmly within the notches (25) of the barrel. At the same time the clasp (37) will be engaged by the catch (38), immobilising the barrel and the loading lever in the position shown in FIG. 1. To fire the rifle the trigger (45) is pressed back and moving clockwise it will push down the rod (43) which in turn will unbalance the spring catch (3) in such a way that its forward hook will free the piston (2). The piston will then be impelled forward at great velocity under pressure from the gas in the deposit which will enter the compression tube (1) by orifices such as (61). The violent displacement of the piston will compress the air contained in the compression tube (1) which in turn will impel the missile (52) along the barrel, transferring to it the energy accumulated during the loading operation. FIG. 1 illustrates the missile as it is being impelled by the piston. To fire again the operation as described must be repeated. It should be stressed that the gas in the deposit does not escape whenever the rifle is fired, as it is prevented from doing so by the sealing rings (4) of the piston (2), as explained above, and on the contrary remains confined within the deposit (7) and in the compensation tube (1) behind the piston (2). The compressed gas, therefore, will serve for any number of firings, as it only acts as an accumulator of energy to be transmitted to the missile. The piston (2) ends its stroke by hitting directly against the hind end of the barrel, thus eliminating any noxious space that could diminish the performance of the weapon. Leakages of gas from around the barrel are prevented by the sealing ring housed in the groove (51). The impact of the piston is absorbed by the air it is compressing ahead of it and by the disc of elastic material (5). As can be appreciated this rifle incorporates new features which undoubtedly will make it outstanding because of its versatility, its functional safety and its notable power and firing distance characteristics. It should be noted that this description does not include details that are not strictly related to the functional aspect of the weapon, such as the stock, aiming sights, etc., which are common to all compressed air rifles.

Having described and determined the nature and scope of this invention and the manner in which it is to be put into practice, it is herewith stated that what is claimed as an invention and of exclusive rights is:

1. A compressed air rifle comprising means defining a cylinder containing a freely slidable piston that divides the interior of the cylinder into a rear chamber adapted to be charged with a compressed gas and a forward chamber defining an air compression chamber, a piston latch in said rear chamber and a trigger operably connected thereto for controlling said latch, means including a unidirectional valve for charging said rear chamber with compressed gas, a member mounted on the forward end of said cylinder having a rifle barrel guide and a projectile insertion opening, an open-ended rifle barrel coaxial with said cylinder slidably mounted in said guide for movement between a first loading position wherein it may receive in its forward open end a projectile inserted through said insertion opening in said member, a second position wherein it has been thrust into said cylinder sufficiently to push said piston into locking engagement with said trigger controlled latch, and a third firing position wherein it closes said insertion opening in said member and its rear open end is substantially at the forward end of said compression chamber whereby when said trigger is actuated to release the piston the piston is impelled by said compressed gas in the rear chamber to move forwardly in said cylinder to compress air in said compression chamber to drive the projectile through said barrel.

2. In the rifle defined in claim 1, means for releasably locking said rifle barrel to said member when the rifle barrel is in said firing position.

3. In the rifle defined in claim 2, said rifle barrel locking means comprising a motion transmitting locking element mounted on a loading lever that is pivotally and slidably mounted on said member.

4. In the rifle defined in claim 3, a first releasable loading lever latch between said loading lever and said member whereby upon release of said first loading lever latch said loading lever may be actuated to move said rifle barrel between said positions.

5. In the rifle defined in claim 4, said loading lever having a pin and slot connection with said member to permit said pivotal and sliding operations, with a second loading lever latch being provided to releasably hold said pin at one end of said slot to hold said loading lever against sliding movement while permitting said loading lever to pivot about said pin upon release of said first loading lever latch to move said locking element out of engagement with said barrel, and there being a traction rod connection between said barrel and the loading lever whereby said pivotal movement of the loading lever effects sliding movement of the rifle barrel.

6. In the rifle defined in claim 5, means for releasing said second loading lever latch allow said pin to move to the other end of said slot whereby to permit sliding movement of the loading lever relative to said member whereby to move said rifle barrel to the loading position.

7. In the rifle defined in claim 1, a loading lever pivotally and slidably mounted on said member mounting a toothed locking element engageable with a corresponding formation on said rifle barrel, a releasable latch between said loading lever and said member, and a traction rod pivoted at opposite ends to said rifle barrel and said loading lever.

8. In the rifle defined in claim 7, the slidable mounting of said loading lever on said member comprising a slot in said member extending generally longitudinally of said barrel, a pin on said loading lever slidable in said slot, and a releasable latch for holding said pin at one end of the slot or for permitting movement of the pin to the other end of said slot enabling the rifle barrel to be moved to said loading position.

9. In the rifle defined in claim 1, means surrounding said cylinder defining a reservoir open to said rear chamber and in a wall of which is disposed said unidirectional valve for introducing compressed gas, and said piston latch being spring biased and said trigger being an external manual trigger.

10. In the rifle defined in claim 9, said reservoir defining means comprising a tube surrounding said cylinder, with said member being sealingly mounted on the forward end of said tube, and there being a valve mounting member sealingly mounted on the rear end of said tube.

* * * * *